US008833379B1

(12) United States Patent
Kaplan

(10) Patent No.: US 8,833,379 B1
(45) Date of Patent: Sep. 16, 2014

(54) CONTAINER ATTACHABLE TO A PERSONAL ELECTRONIC DEVICE

(76) Inventor: Barrie Beth Kaplan, Mamaroneck, NY (US)

( * ) Notice: Subject to any disclaimer, the term of this patent is extended or adjusted under 35 U.S.C. 154(b) by 0 days.

(21) Appl. No.: 12/691,386

(22) Filed: Jan. 21, 2010

Related U.S. Application Data

(60) Provisional application No. 61/176,295, filed on May 7, 2009.

(51) Int. Cl.

| | |
|---|---|
| ***A45D 33/20*** | (2006.01) |
| ***A45D 40/24*** | (2006.01) |
| ***A45D 42/00*** | (2006.01) |
| ***B65D 69/00*** | (2006.01) |
| ***B65D 71/00*** | (2006.01) |
| ***B65D 85/00*** | (2006.01) |
| ***H04M 1/00*** | (2006.01) |
| ***H04B 1/38*** | (2006.01) |
| ***H04B 1/06*** | (2006.01) |
| ***H05K 11/00*** | (2006.01) |
| ***H04B 1/08*** | (2006.01) |
| ***A45D 33/26*** | (2006.01) |

(52) U.S. Cl.
CPC ..... *A45D 33/26* (2013.01); *Y10S 206/823* (2013.01)
USPC ..... 132/287; 132/314; 132/316; 206/235; 206/581; 206/823; 206/320; 455/566; 455/344; 455/347; 455/575.1

(58) Field of Classification Search
CPC ..... A45D 33/20; A45D 33/26; A45D 33/28; A45D 33/008; A45D 40/18; A45D 40/24; A45C 11/008; A24F 15/18; A24F 15/12; H05K 11/00; H04B 1/08
USPC ..... 132/287, 75, 288, 286, 291, 294, 295, 132/297, 300, 301, 303, 304, 309, 312, 132/314–318; 206/581, 823, 38, 235, 37, 206/39.4, 39.5, 562, 39.6, 320; D3/901; 455/344, 351, 550.1, 556.1, 575.8, 455/575.1, 899, 566, 347; 150/106; 224/901, 901.2; 24/304; 248/682, 690; 292/300, 302
See application file for complete search history.

(56) References Cited

U.S. PATENT DOCUMENTS

| | | | | |
|---|---|---|---|---|
| 1,800,230 | A | 4/1931 | Rosenthal | |
| 3,134,383 | A * | 5/1964 | Thompson | 132/288 |

(Continued)

FOREIGN PATENT DOCUMENTS

| | | | |
|---|---|---|---|
| JP | 2000299719 | A * | 10/2000 |
| WO | WO 2004051968 | A1 * | 6/2004 |

*Primary Examiner* — Vanitha Elgart
(74) *Attorney, Agent, or Firm* — Andrew S. Langsam; Pryor Cashman LLP

(57) ABSTRACT

A pocket-sized container securable to the back of a mobile phone or smart-phone-like device for a personal care product (preferably a cosmetic) includes a housing substantially smaller than the phone and provided with an adhesive layer on its bottom surface for securing the housing to the rear surface of the phone. The top surface of the housing has a substantially reflective mirror-like surface. The container includes a sliding drawer having a personal care product contained therein (pills, mints, cosmetics, blush, lip gloss, etc.). The drawer is slidable into and out of the housing to provide access to the personal care product while the housing is adhered to the phone. The drawer preferably includes a pair of opposed finger-gripping surfaces, such as raised ridges or projections, adapted to facilitate sliding of the drawer out of the housing. Replaceable trays of personal care products can be inserted into the drawer, as desired.

11 Claims, 10 Drawing Sheets

(56) References Cited

U.S. PATENT DOCUMENTS

| | | | | |
|---|---|---|---|---|
| 4,898,195 | A * | 2/1990 | Sussman | 132/317 |
| 5,054,505 | A * | 10/1991 | Yuhara | 132/294 |
| 5,152,307 | A * | 10/1992 | Schlaszus | 132/314 |
| 5,163,457 | A * | 11/1992 | Lombardi, Jr. | 132/304 |
| 5,318,053 | A * | 6/1994 | Barnhart | 132/297 |
| 5,329,947 | A * | 7/1994 | Shikler | 132/304 |
| 5,337,890 | A | 8/1994 | Lai | |
| 5,845,658 | A * | 12/1998 | Sussman | 132/287 |
| 6,311,077 | B1 * | 10/2001 | Bien | 455/566 |
| 6,341,710 | B1 * | 1/2002 | Danielson et al. | 220/281 |
| 6,363,947 | B1 * | 4/2002 | Wu | 132/297 |
| 6,386,210 | B1 * | 5/2002 | Slater | 132/294 |
| 6,424,823 | B1 | 7/2002 | Moles | |
| D470,627 | S | 2/2003 | Kuo | |
| 6,530,509 | B1 * | 3/2003 | Davis | 224/219 |
| 6,788,919 | B2 * | 9/2004 | Watanabe | 455/90.3 |
| 7,146,184 | B1 * | 12/2006 | Tsitsiashvili | 455/550.1 |
| 7,431,161 | B2 * | 10/2008 | Carlino | 206/581 |
| 7,828,000 | B2 * | 11/2010 | Lee | 132/287 |
| 7,905,238 | B2 * | 3/2011 | Moon | 132/287 |
| 7,984,804 | B2 * | 7/2011 | Lebauer | 206/320 |
| 8,047,364 | B2 * | 11/2011 | Longinotti-Buitoni | 206/320 |
| 2003/0121818 | A1 * | 7/2003 | Carter | 206/483 |
| 2005/0277453 | A1 | 12/2005 | Kim | |
| 2006/0027481 | A1 * | 2/2006 | Gelardi et al. | 206/581 |
| 2006/0042971 | A1 * | 3/2006 | Holmes et al. | 206/235 |
| 2007/0017848 | A1 * | 1/2007 | Sasaki | 206/581 |
| 2007/0029225 | A1 * | 2/2007 | Ko et al. | 206/581 |
| 2007/0080094 | A1 * | 4/2007 | Moon | 206/581 |
| 2007/0097615 | A1 * | 5/2007 | Liao et al. | 361/683 |
| 2008/0047990 | A1 * | 2/2008 | Morgan et al. | 224/222 |
| 2008/0245383 | A1 * | 10/2008 | Tomandl | 132/200 |
| 2008/0245386 | A1 * | 10/2008 | Steele | 132/318 |
| 2009/0044825 | A1 * | 2/2009 | Lawrence et al. | 132/295 |
| 2009/0044827 | A1 * | 2/2009 | Zilber et al. | 132/297 |
| 2009/0045091 | A1 * | 2/2009 | O'Neill et al. | 206/449 |
| 2009/0071867 | A1 * | 3/2009 | Au | 206/581 |
| 2009/0078279 | A1 * | 3/2009 | Boye et al. | 132/295 |
| 2009/0166247 | A1 * | 7/2009 | Gindi | 206/581 |
| 2009/0229628 | A1 * | 9/2009 | Slattery et al. | 132/288 |
| 2010/0122439 | A1 * | 5/2010 | Britton et al. | 24/306 |
| 2010/0147716 | A1 * | 6/2010 | Jones | 206/320 |
| 2010/0326461 | A1 * | 12/2010 | Arrendol et al. | 132/312 |
| 2011/0011754 | A1 * | 1/2011 | Nordstrom | 206/37 |
| 2011/0077061 | A1 * | 3/2011 | Danze et al. | 455/575.1 |
| 2011/0089077 | A1 * | 4/2011 | Ziemba | 206/570 |
| 2012/0264491 | A1 * | 10/2012 | Singhal | 455/575.1 |

* cited by examiner

CONTAINER ATTACHABLE TO A PERSONAL ELECTRONIC DEVICE

RELATED APPLICATIONS

Domestic priority is claimed from U.S. Provisional Patent Application No. 61/176,295, filed May 7, 2009 and entitled "Cosmetic Container Attachable to an Electronic Device," the entirety of which is incorporated by reference herein.

BACKGROUND OF THE INVENTION

1. Field of the Invention

The invention is related to a container, preferably for makeup or cosmetics in general and small-quantity makeup-holding containers in particular. More specifically, the invention is related to an extremely portable and compact container attachable to a personal electronic device such as a cell phone or personal digital assistant ("PDA") which can small products, including breath mints, pills, lip gloss, rouge, etc.

2. Description of Related Art

In many countries, the majority of the population carries at least one hand-held or otherwise portable electronic device, such as a cell phone, a PDA (e.g., a Blackberry® device, made by Research in Motion, Ltd., of Waterloo, Ontario, Canada, and/or an iPhone® cell-phone, made by Apple, Inc., of Cupertino, Calif.), or similar device which carries both their personal and business data (hereinafter collectively and generically "PDAs" or "personal electronic devices"). There has been a trend towards combining several functions of different types within the same device so as to minimize pocket or purse clutter and to make the products more integrated, useful and convenient. So-called "smart phones" with phone, message, calendar, internet access, camera functions, etc. are becoming more and more common. There has also been a trend to shrink the size of PDAs to make them as portable as possible, preferably pocket-sized (meaning, able to fit within the average person's pants pocket comfortably).

Of that majority of PDA users or carriers, roughly 50% are women. Women have been known to use cosmetics for hundreds, possibly thousands, of years. Women will not merely be content to apply cosmetics at the beginning of the day; many will typically apply and/or re-apply some form of cosmetics throughout the day, even when away from home or work. However, if one is out and about, it becomes cumbersome to carry a cell phone or PDA, a wallet for one's cash, credit cards, train passes, identification cards or badges, and the like, and containers of cosmetics as well. It is a further burden to also carry a mirror which can be helpful if not critical in the proper application of make-up and cosmetics. The greater the number of such items a person carries around, the bulkier the entire set of such necessities, the greater the likelihood that she will either forget one or more of the items at home, and the greater the likelihood that she will misplace one in a restaurant, bar, office, etc. Even were one not to lose or misplace anything, fumbling around looking for cosmetics and a mirror while holding a PDA or vice versa wastes time, is uncomfortable for the user, and reduces the "cool" factor of using today's most modern electronic components, the cutting edge PDA or smart phone. There is a long-felt need to somehow make carrying and applying cosmetics more convenient and efficient, especially for those who are already carrying a PDA or cell phone and may not wish to carry a purse or handbag to contain a variety of additional items (e.g., money, the PDA, cosmetics, a mirror, etc.). There is also a perceived need for a device securable to a PDA or smart phone which is a holding container for other small objects, e.g., pills, breath mints, bobby pins, earrings, etc.

Some progress has been attempted in this endeavor, however all previous attempts have been less than entirely successful.

A number of small cosmetic cases have been developed, e.g., those described in U.S. Pat. No. 1,800,230 to Rosenthal; U.S. Pat. No. 5,163,457 to Lombardi; and U.S. Pat. No. 5,337,890 to Lai. All of these are separate cosmetic cases that, while attempting to be extremely compact in nature, offer some relief to the problem mentioned above, i.e., of carrying a PDA and a cosmetics case. All of these are also provided with internal mirrors. However, that means that the user must take the step of opening the cosmetic-carrying case merely to see what one looks like, whether an application of cosmetics is required or not. Two prior attempts, U.S. Pat. No. 6,363,947 to Wu and U.S. Design Pat. No. D470,627 to Kuo disclose cosmetics cases in the shape of cell phones. These solve none of the problems mentioned above and indeed additionally may tend to confuse the user in a club or restaurant setting as to which pocket-sized device is her cell phone and which is her makeup case.

A few other attempts in this field teach a cell phone having an integral mirror or reflective surface on its case, and optionally a light source for use in conjunction with that mirror. Some examples of this category of device include U.S. Pat. No. 6,424,823 to Moles; US Patent Application Publication No. 2005/0277453 to Kim; and Japanese Patent Application Publication No. 2000-299719 to Horie et al. Like the above-mentioned prior references, all of these teach an internal mirror that require the user to first take the step to open the device to access and use the mirror. Additionally, none of these teach any kind of cosmetics container; thus, a separate cosmetics container must be carried and inartfully handled while attempting to open and hold the mirror provided by one's cell phone.

There are also known cell phones having both an integral mirror and cosmetics holding compartments, such as those described in U.S. Pat. No. 6,311,077 to Bien and U.S. Pat. No. 7,146,184 to Tsitsiashvili. At the very least, one need not carry a separate cosmetics container with either of these devices. However, in both cases, the mirror is again internal to the casing so that the device must be opened to use the mirror and make even a determination whether cosmetics are required. Additionally, both of these cosmetic carrying devices are wholly integrated with the cell phone. This causes two problems. For one, it is likely impossible to use the cell phone while applying makeup. For another, people are extremely attached to their PDAs and do not want to have to purchase a different PDA or cell phone just to be able to have an integral cosmetics kit formed inside. It is especially onerous presently to switch out a cell phone from a wireless carrier and its tying contract, as many of the major wireless providers lock a user into a two-year contract with stiff early termination penalties.

Finally, there have been described at least two cosmetics containers that are separate from but attachable to existing cell phones, namely, U.S. Pat. No. 6,788,919 to Watanabe and International Patent Application Publication No. WO 2004/051968 to Napier-Clark. These are also flawed, for several reasons. First, in both cases, the cosmetics container is substantially the same size at the cell phone. Thus, even though the cosmetics case is attached to the cell phone, it is not really that convenient, as it adds nearly 100% of the overall profile of the cell phone to the cell phone. Put another way, using either of these devices is like carrying two cell phones' worth of weight and bulk, which fails to remain pocket-sized or comfortable at all. Second, in both cases, as above, the mirror is disposed in an internal portion of the housing, so that the housing must be opened in the manner of a conventional compact case to view one's appearance. This makes it difficult to answer a call or otherwise use the phone while applying makeup, and it requires some effort to view the mirror. Also, there does not seem to have been presented a solution to another problem which is anticipated, namely, replacement or swapping of cosmetics (or contained articles) in the case, from one day or event to the next. The present invention allows for a small tray containing the articles, e.g., breath mints, pills, saccharine tablets, pins, small earrings, etc., or cosmetics to be held and accessed from a container, attached to the rear of the cell phone or PDA, and of small size so as not to increase the overall size to an uncomfortable size, with a mirror easily available without opening first the compartment or the cosmetic case.

SUMMARY OF THE INVENTION

In light of the deficiencies of the prior art, the invention is a pocket-sized beauty care or other small product container adapted to be secured easily and quickly to the back of a personal electronic device. The inventive container includes a housing with a bottom surface having an adhesive layer for securing the housing to the rear or bottom surface of the personal electronic device. The housing includes a top surface, opposed to the bottom surface. The top surface has an externally and immediately visible substantially reflective surface (e.g., a mirror), sides, and a front opening. A drawer having sides, a front face, and a beauty care product (e.g., lip gloss, eye shadow, or the like) contained within the drawer is slidably provided into and out of the front opening of the housing to provide finger access to the beauty care product. Of course, the drawer can contain any one or more small products, e.g., medication pills, pins, breath mints, etc. This drawer or tray can quickly and easily be swapped for another tray or drawer with the same (replacement when the first quantity is used up) or a different color or even type of cosmetic or product, as desired. Preferably, the perimeter or overall profile of the housing for the drawer is substantially smaller than the perimeter of the personal electronic device to which it is securable.

The drawer is preferably provided with a pair of opposed finger gripping surfaces adapted to facilitate the sliding of the drawer into and out of the housing. The finger gripping surfaces may optionally extend outwardly from sides of the drawer and near the front face of the drawer and include raised ridges, all to tactile advantage in manipulating the drawer into and out of the device, as needed.

Optionally, the adhesive layer that secures the housing to the personal electronic device is at least one of either a heat-activated or pressure-activated fastening material. The adhesive layer is preferably initially provided with removable release paper to allow the purchaser to obtain the same in a retail store and then to place and secure the same onto one's PDA.

BRIEF DESCRIPTION OF THE DRAWINGS

FIGS. 3A and 3D are top perspective views; FIG. 3B is a top elevation view; FIG. 3C is a front elevation view; and FIG. 3E is a bottom perspective view.

FIGS. 4A and 4D are top perspective views; FIG. 4B is a top elevation view; FIG. 4C is a front elevation view; and FIG. 4E is an enlarged sectional view taken along line 4E-4E of FIG. 4C.

DETAILED DESCRIPTION OF THE INVENTION AND DRAWINGS

Description will now be given with reference to the attached FIGS. 1-8. It should be understood that these figures are exemplary in nature and in no way serve to limit the scope of the invention, which is defined by the claims appearing hereinbelow.

Figure 6A:
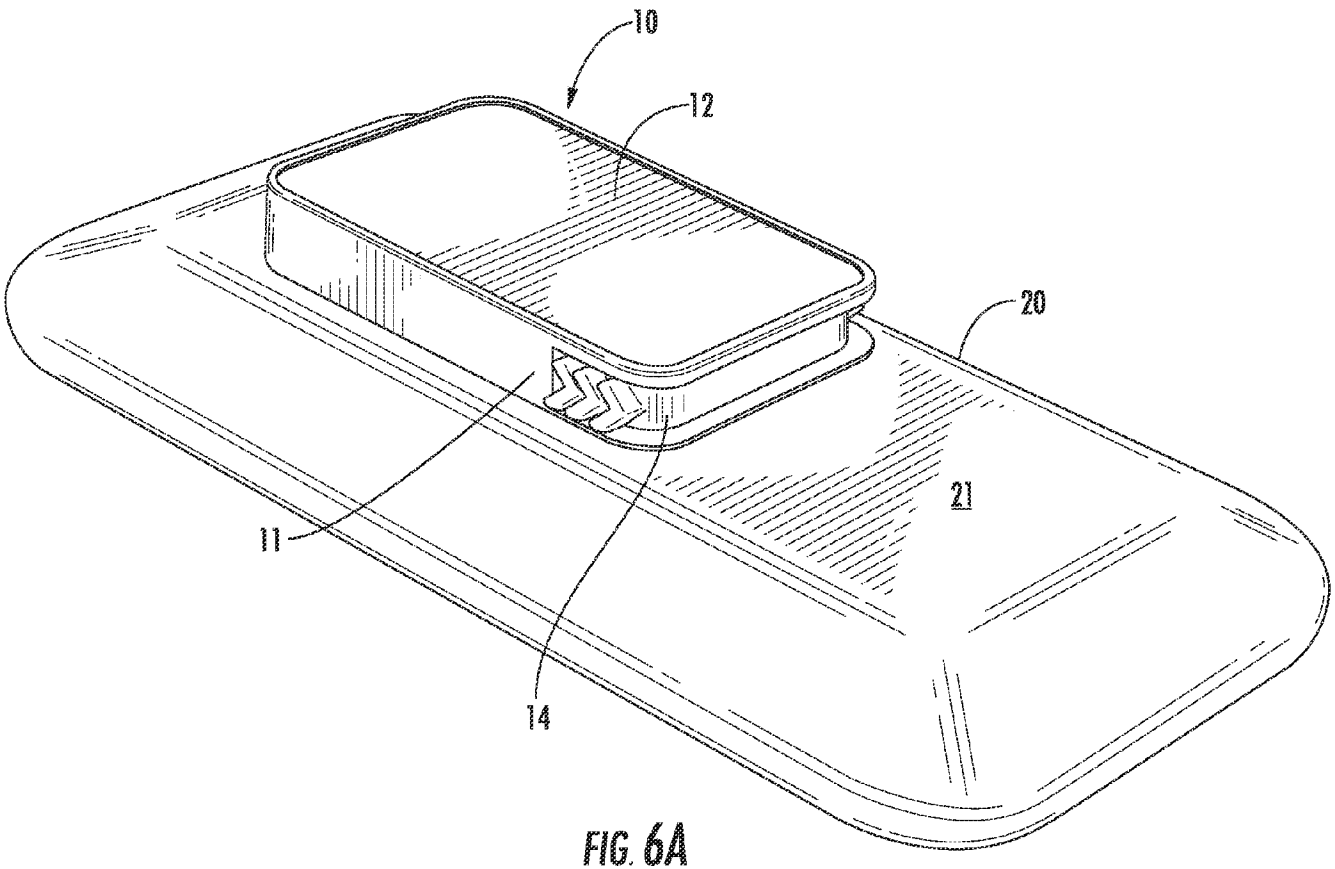
FIG. 6A is a perspective view of a cosmetics or small products container in accordance with the invention in a closed configuration and securely mounted to the rear surface of a personal electronic device.
Figure 6B:
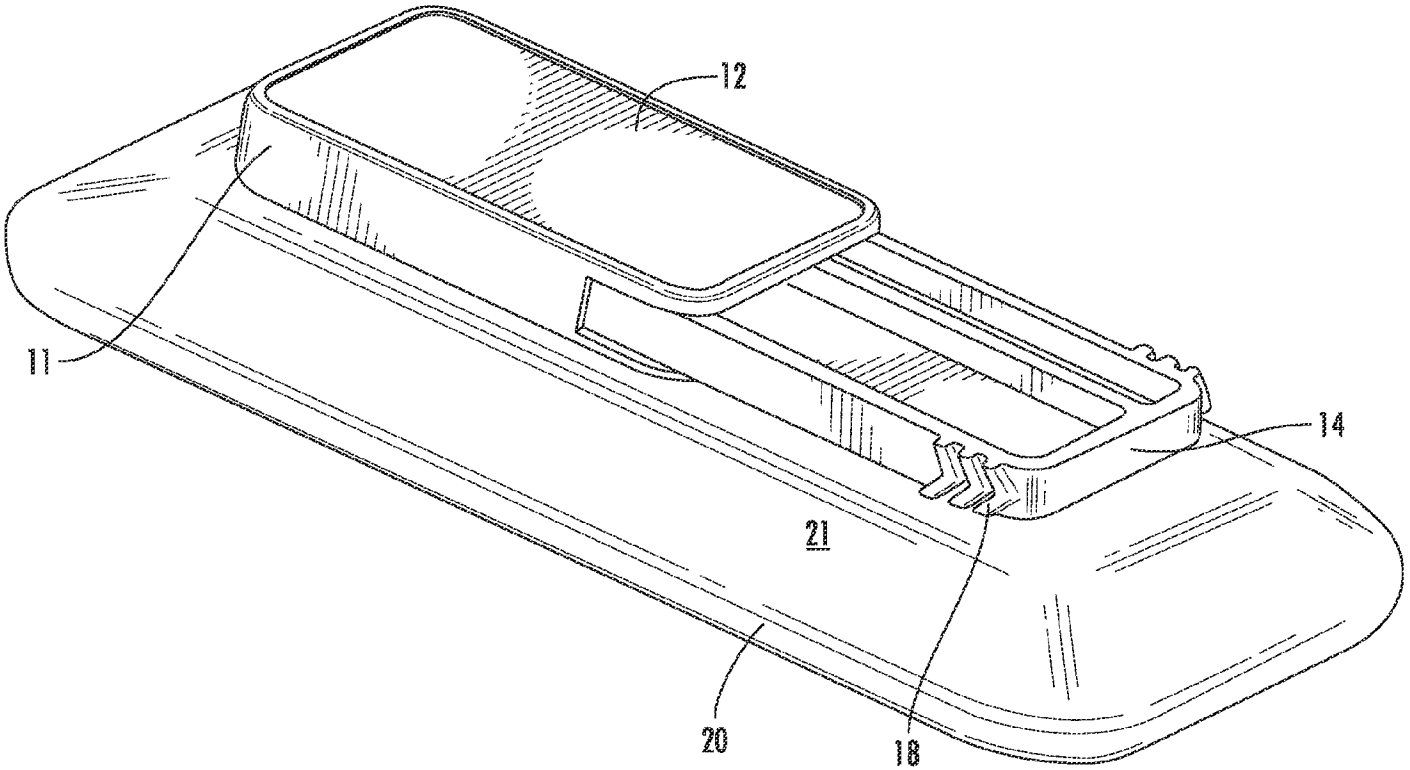
FIG. 6B is a perspective view of the cosmetics or small products container of FIG. 6A in an open configuration mounted to the rear surface of a personal electronic device.

An extremely portable cosmetics or small products container 10 is provided. It is mountable on the rear surface 21 of a personal electronic device or PDA 20 (see FIGS. 6A-B, for example), such as an MP3 player, a cell phone, smart phone, or any other similar PDA. Container 10 is mounted to PDA 20 by any number of means, for example, double-sided tape, corresponding strips of mating hook and loop fasteners (e.g., Velcro® fastening materials) each adhered to container 10 and PDA 20, respectively; or directly with adhesive, or the like. In the latter instance, the adhesive may be pressure activated or heat activated. Of significant importance is the relative sizing of container 10 with respect to PDA 20. As shown in FIGS. 6 and 7, the perimeter of container 10 is substantially smaller and thus inwardly recessed, than the perimeter of the PDA 20 to which it is securable. In FIGS. 6 and 7, the size difference of PDA 20 to container 10 is approximately 2:1. The aspect ratio (relative width to length) of container 10 need not be identical to that of PDA 20, however the overall area of rear surface 21 of PDA 20 occupied by container 10 is preferably in the range of 20%-75%, preferably in the range of 25%-66% and most preferably approximately 50% of that of the PDA. Even when the cosmetic or other small product container 10 is opened, it will be seen from FIG. 6B, that the container and the drawer are preferably within the outside perimeter defined by the PDA 20. This ensures that when the user places an application brush or his/her finger into the container to remove a small product and/or to obtain cosmetics therefrom (like lip gloss or rouge onto the tip of a finger), there is a support surface, the rear or bottom of the PDA, to hold the container and to provide support to make such action easier, convenient and less problematic. As many PDAs have small cameras on the rear surface of their housings, it is preferred that the container, when closed, not occupy substantially more than 75% of the rear surface area of the PDA. The preferred thickness (i.e., the height extending above or from rear surface 21 of PDA 20) of container 10 is generally under about 10 mm. The overall volume of container 10 must be large enough to contain a useful quantity of small products or a supply tray of cosmetics (usable multiple times) but small enough so as not to overly enlarge the overall profile of PDA 20 to render it no longer pocket-sized or uncomfortable to carry in a pocket.

As shown in various embodiments in the figures, container 10 includes a mirror or reflective surface 12 on its top side. Reflective surface 12 may be deposited directly onto and formed integrally with the top surface of container 10, or it may take the form of a separate, yet thin, mirror that is adhered or otherwise secured by the manufacturer to the top surface of container 10. In either event, providing a mirror 12 on the top side of container 10 enables the user to quickly and easily determine if she (or he) requires an application or re-application of makeup simply by looking at the back of her PDA. One need not open a device or carry a separate cosmetics container or separate mirror to determine if one needs to apply makeup to one's face. On its bottom surface, container 10 is provided with adhesive layer 19 for enabling container 10 to be attached at least semi-permanently to rear surface 21 of PDA 20. The adhesive may be pressure-activated, heat-activated, or the like, and preferably includes a removable, release strip or sheet (not shown) for protecting the adhesive layer 19 until it is desired to attach container 10 to PDA 20. The securement of the container to the PDA can be permanent or, alternatively, it is within the scope of the invention for the securement to be releasable and re-secured to the same or a different PDA, by use of suitable adhesive/securing mechanisms.

In the preferred embodiment of FIGS. 1-6, container 10 includes a main housing 11 adapted to receive a drawer or tray 14 preferably slidable into and out of main housing 11. Sliding drawer 14 includes at least one recessed compartment 16 for storing a quantity of cosmetics and/or cosmetics accessories, such as brushes, tweezers, or the like, or other small products. The sliding drawer 14 preferably also includes one or more opposed, outwardly extending, finger grippable protrusions 18 formed on the proximal ends of the side walls of drawer 14 for facilitating the user's grasping of the drawer 14 to slide it out of housing 11 and to replace the same, after use. Protrusions 18 may also facilitate the user's insertion of drawer 14 into housing 11, however this action is easier than withdrawing drawer 14 because one may merely push on the front face of the drawer 14 and push the drawer into the housing without necessarily grasping the sides of the drawer.

Figure 1:
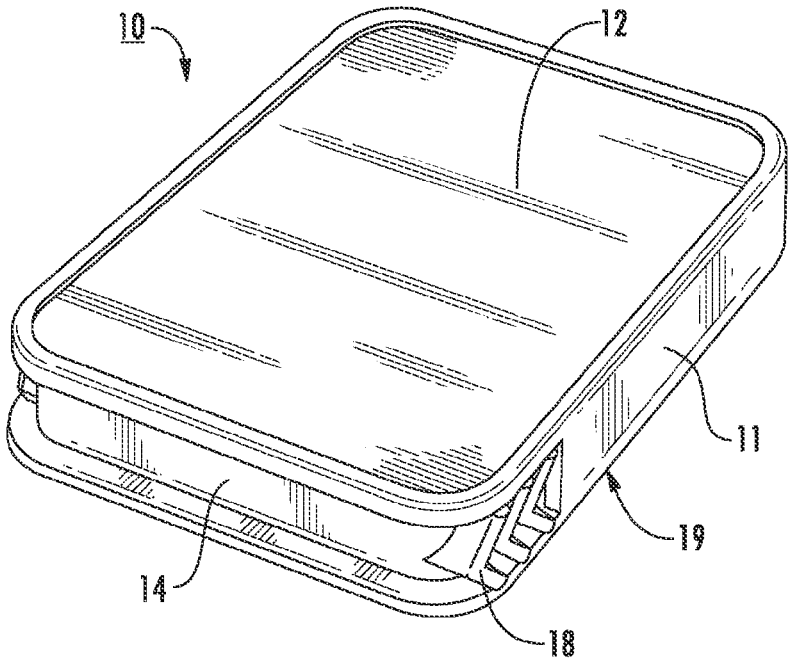
FIG. 1 is a perspective view of a cosmetics or small products container in a closed configuration in accordance with the invention.
Figure 2:
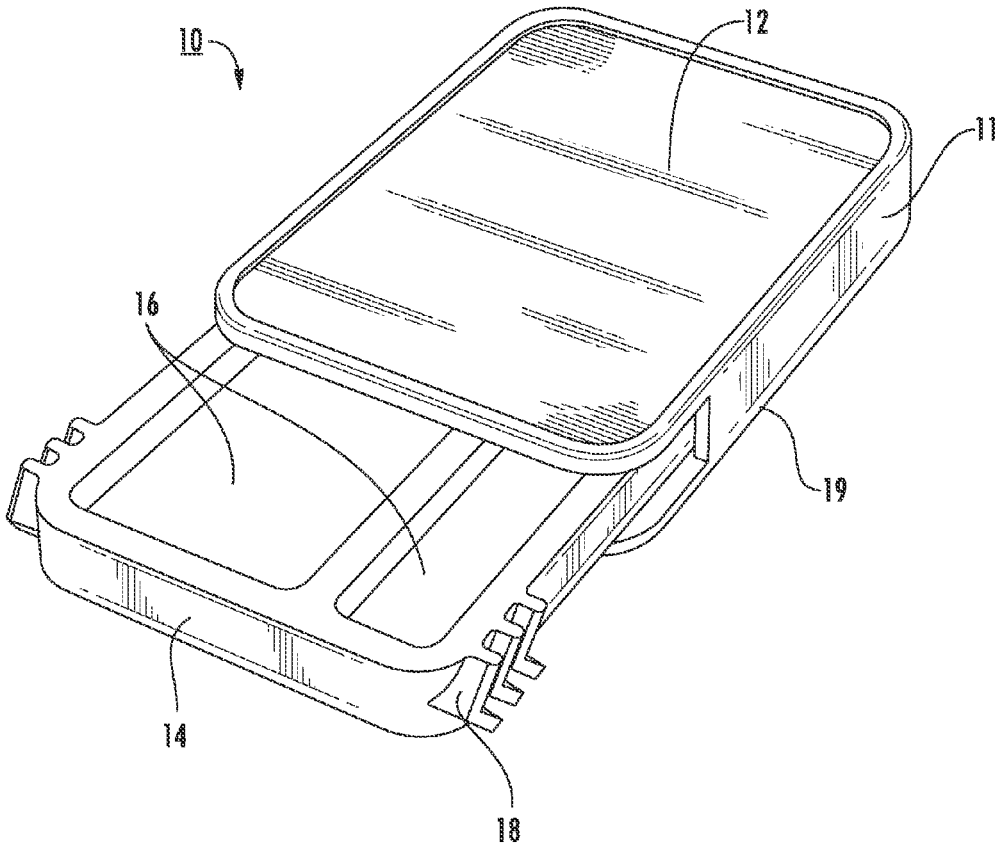
FIG. 2 is a perspective view of the cosmetics or small products container of FIG. 1 in an open configuration, allowing access to the cosmetics or small products contained in the drawer.
Figure 3B:
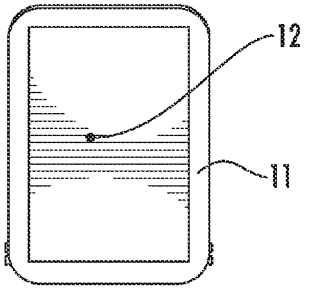
FIGS. 3A-E are various views of a cosmetics container or small products holder in accordance with the invention.
Figure 3A:
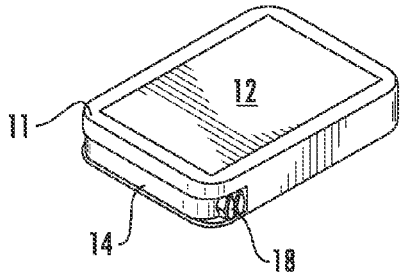
Figure 3C:
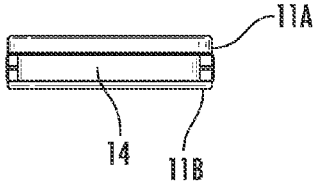
Figure 3D:
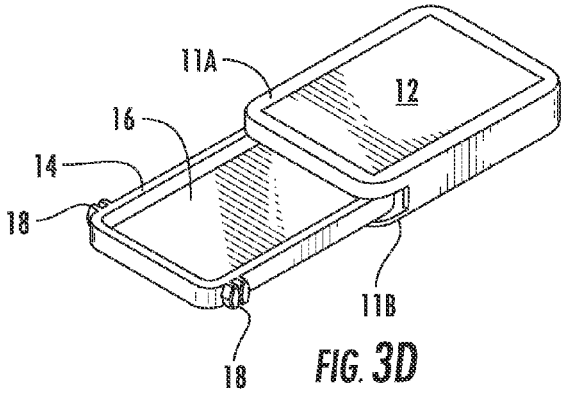
Figure 3E:
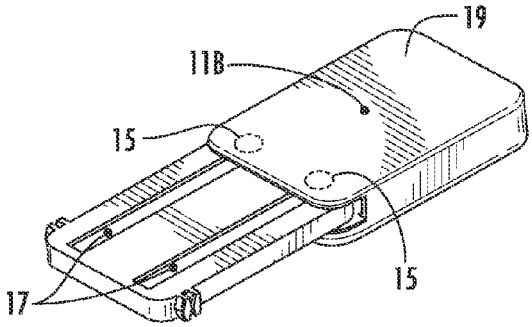

Housing 11 may take one of several forms. For example, in FIG. 3, housing 11 includes an upper portion 11A and a lower portion 11B which together substantially surround drawer 14. Portions 11A and 11B may be secured together via snap fit, adhesive, sonic or other plastic welding, or any known and effective manufacturing techniques. Preferably, as shown in FIG. 3E, a bottom perspective view, drawer 14 includes one or more (in this case two) longitudinal tracks or grooves 17 for stability of motion of the drawer and to ensure the drawer does not get canted with respect to housing 11 and thus possibly stuck jutting out of housing 11 at an angle. Corresponding upwardly facing projections 15 (shown in outline in FIG. 3E) are formed on the inner surface of lower portion 11B and sit inside grooves 17. Grooves 17 may be made to extend all the way to the very distal end of drawer 14 (the end that is inserted into housing 11) which would allow drawer 14 to be easily and completely removed from housing 11. Alternatively, grooves 17 may terminate prior to the distal end of drawer 14, to thereby provide a stop mechanism to substantially retain the drawer within the housing and to prevent drawer 14 from being accidentally fully removed from housing 11 unless a significant overriding amount of force is intentionally applied. To that end, projections 15 may be appropriately angled so that drawer 14 is easily inserted into housing 11 by sliding over the sloped or angled top surface of projections 15 but not as easily removed as the distal end walls of the grooves catch on the rear portion of projections 15. The mechanical interaction of the projections and the grooves is similar to a ratchet mechanism, allowing for ease of movement in one direction but a stop in the other, unless the force of the stop is deliberately overcome.

Figure 4A:
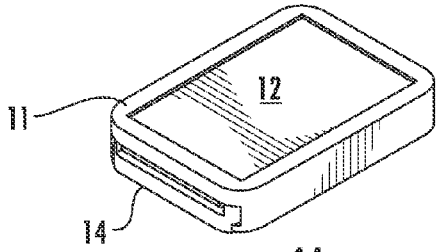
FIGS. 4A-E are various views of a cosmetics or small products container in accordance with the invention.
Figure 4B:
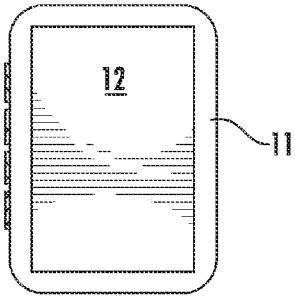
Figure 4D:
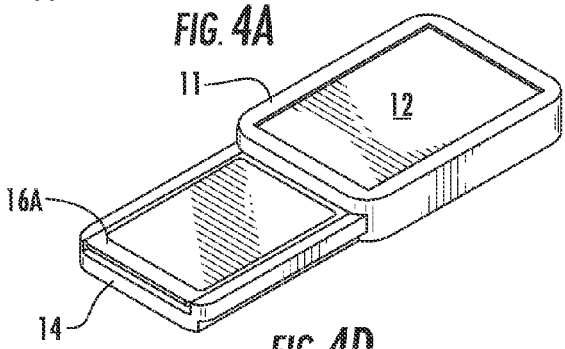
Figure 4C:
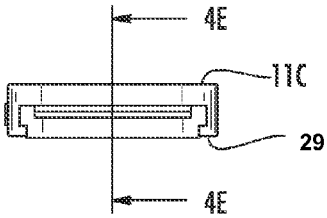
Figure 4E:
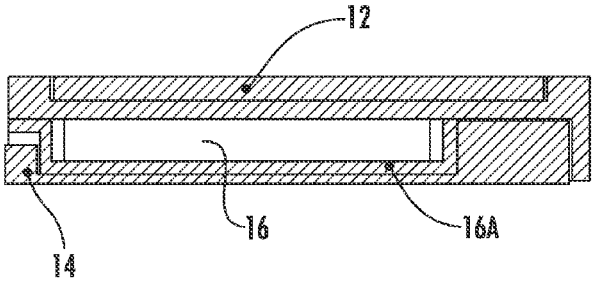
Figure 5:
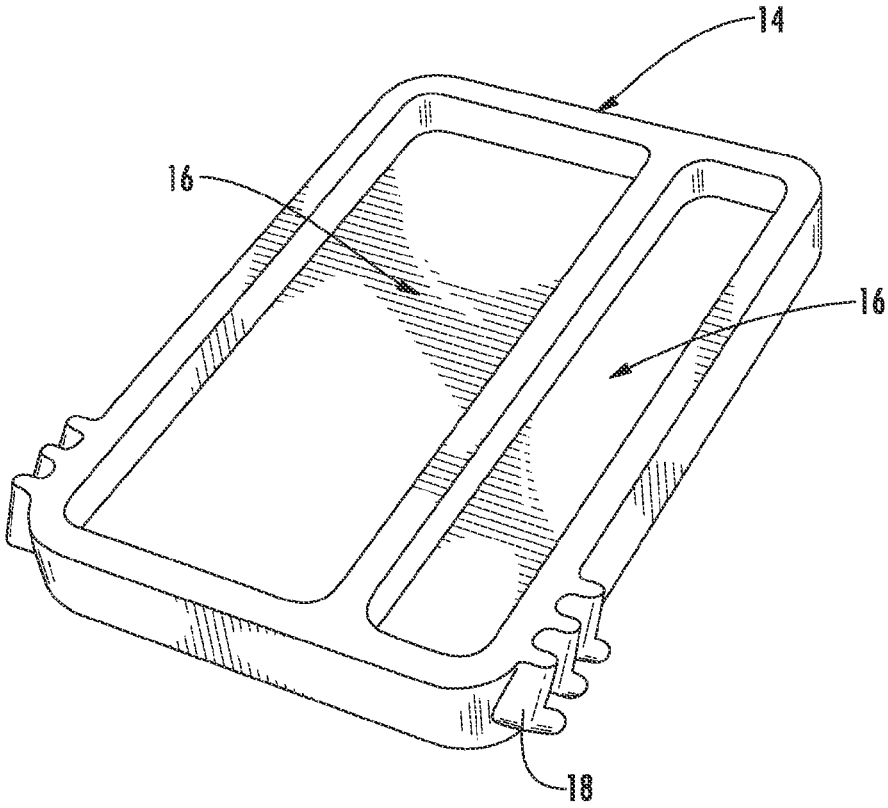
FIG. 5 is a perspective view of a slidable tray of the cosmetics or small products container in accordance with the invention.

In another version of the invention, as shown in FIG. 4, instead of a two-piece housing, a single housing portion 11C is provided having a substantially C-shaped cross-section (see FIG. 4E). That is, there is largely no bottom portion of housing 11C existing between sliding drawer 14 and the PDA 20 (See FIGS. 4C and 4E). As an option, cosmetic receptacle or drawer 14 is provided with a removable tray or pan 16A. With the above embodiment of FIG. 3, either the entire drawer 14 must be replaced when the cosmetics or small products are spent or used up, or the entire container 10 must be replaced (if the drawer is not removable from housing 11). Here, in the embodiment shown in FIG. 4, while drawer 14 may or may not be entirely removable from housing 11C, drawer 14 is sufficiently removable that a spent or used up tray 16A can be removed from receptacle 16 and a new and small products or cosmetics-filled tray 16A can replace it (see FIGS. 4D and 4E). The drawer 14 is provided with a pair of laterally and outwardly extending side bars which glide over and are supported by a pair of inwardly directed, bottom support rails 19.

Figure 7A:
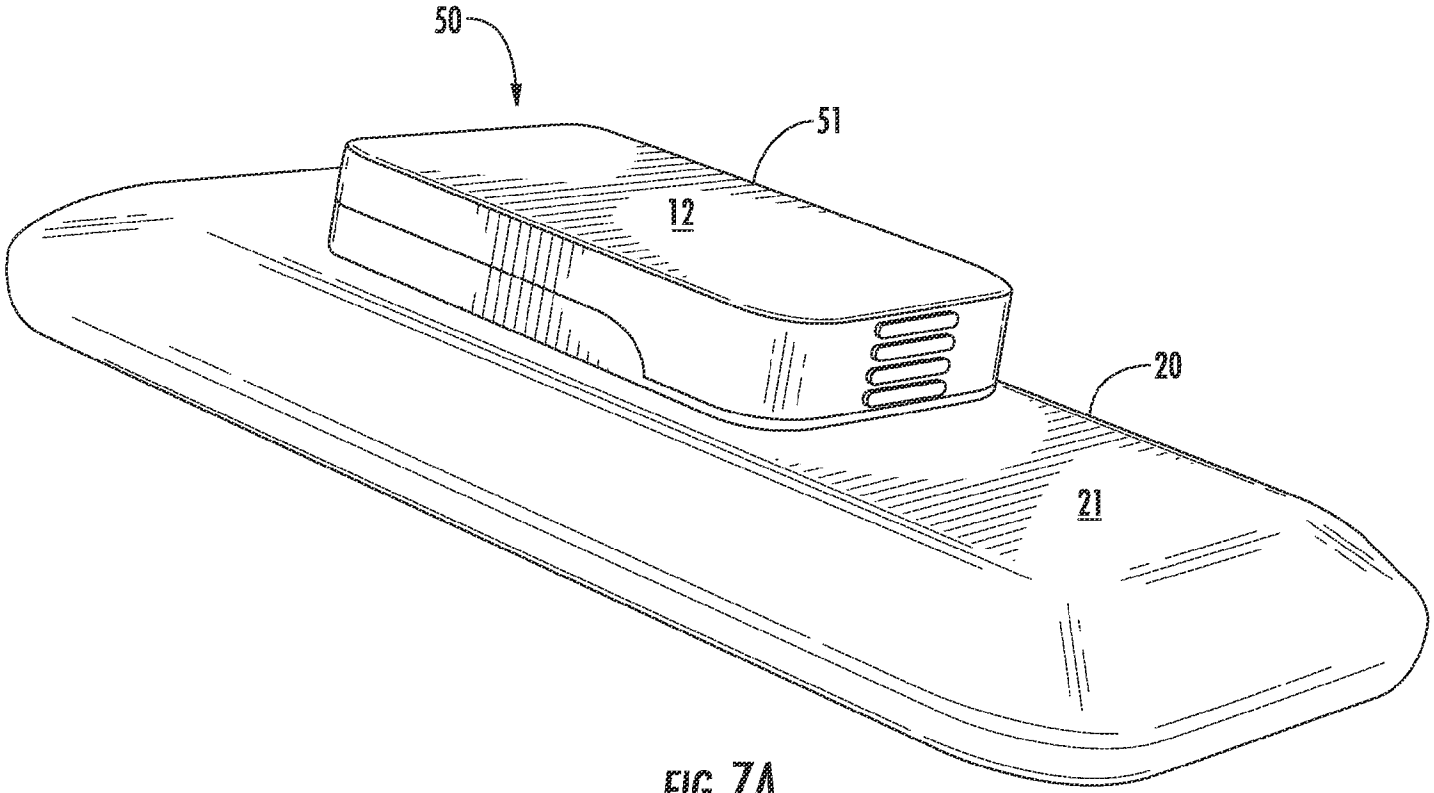
FIG. 7A is a perspective view of an alternate cosmetics or small products container in accordance with the invention in a closed configuration mounted to the rear surface of a personal electronic device.
Figure 7B:
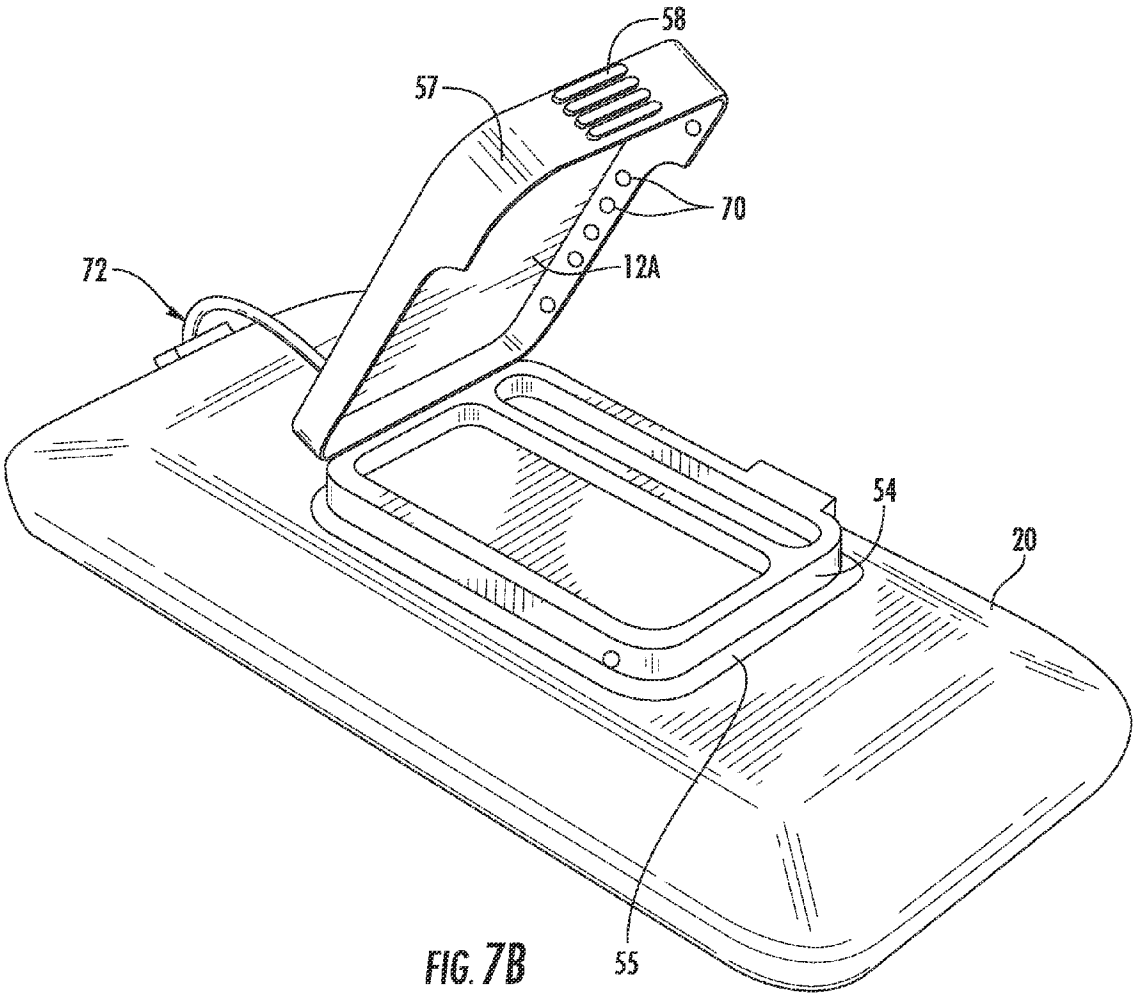
FIG. 7B is a perspective view of the cosmetics or small products container of FIG. 7A in an open configuration mounted to the rear surface of a personal electronic device.
Figure 8:
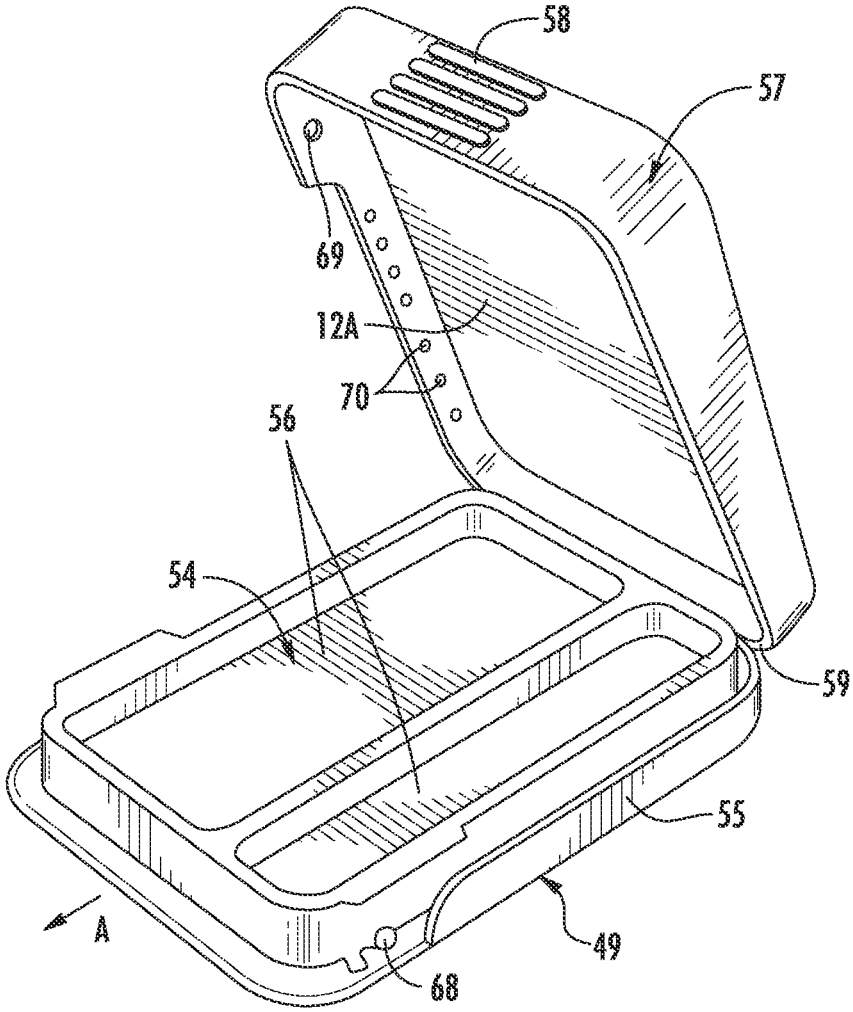
FIG. 8 is a perspective view of the cosmetics or small products container of FIGS. 7A and 7B in an open configuration.

A slight variation on the above is shown in FIGS. 7A, 7B and-8. Here, cosmetics container 50 includes a housing 51 and a container or drawer 54. Drawer 54 may slide into and out of housing 51 as indicated by arrow A (see FIG. 8) or it may remain in a fixed position with respect to housing 51, since the cosmetics or small products in drawer 54 are immediately accessible when the housing is opened (as explained below). As above, container 50 is attached to PDA 20 (see FIG. 7) via adhesive 49 (see FIG. 8), or via similar means. Housing 51 includes a lower base portion 55 and an upper lid portion 57. Upper lid portion 57 is attached to lower base portion 55 via a single back hinge 59. Hinge 59 may be a living hinge formed integrally with the upper lid and lower base portions 57 and 55 and made of the same flexible material as the housing, or it may be made from two parts that move with respect to each other, or any other type of known hinge or flexural joint. Upper lid portion 57 preferably has protrusions 58 located at the proximal end (the front) so that a user may more easily grip upper lid portion 57 and open or close it. The upper lid portion includes preferably an exterior mirror 12 as before but may also optionally include an internal mirror 12A as shown in FIGS. 7B and 8. Mirrors 12 and 12A may be substantially the same, or they may be different, i.e., one may be a typical flat mirror and the other a magnifying mirror. Optionally, one or more small lights 70 (see FIGS. 7B and 8) may be provided in the interior of upper lid portion 57 so as to illuminate internal mirror 12A. An appropriate battery or power supply may be connected to the light along with a switch, either a toggle switch or a switch connected to the upper lid portion that automatically activates the light when the lid is opened. Optionally, the light of the cosmetics case may be connectable to the PDA itself, e.g., via mini-cable 72 (see FIG. 7B; typically a mini-USB-type connection, or the like) so that the PDA's battery can power the light. A detent mechanism including protrusions 68 that mate with corresponding detents 69 (see FIG. 8) may also be provided on the housing 51. Although detents 69 are shown on upper lid portion 57 and protrusions 68 are shown on lower base portion 55, they may be reversed, or one side of the container may be configured in the opposite manner to the other side or even only one side of the container provided with a corresponding protrusion and recess for holding the device in the closed position. Optionally, the cover can be provided with a spring-like mechanism for holding the container open, when the cover is opened a pre-determined minimum, lest the cover inadvertently close as a consequence of the springiness of the live hinge. Of course, the force of the spring can be manually overcome to selectively close the container, by pushing the cover down over the housing, such that the protrusion(s) are captured by the detent(s).

In all embodiments, housing 11 and drawer 14 are preferably made of a light-weight material such as plastic, aluminum, or the like. Just as it is intended that the container 10 be small enough not to interfere with the operation and portability of PDA 20, it is also intended that container 10 be light weight enough not to make carrying PDA 20 with container 10 burdensome or more easily dropped.

Having described certain embodiments of the invention, it should be understood that the invention is not limited to the above description or the attached exemplary drawings. Rather, the scope of the invention is defined by the claims appearing hereinbelow and any equivalents thereof as would be appreciated by one of ordinary skill in the art.

What is claimed is:

1. A personal care product container adapted to be secured to a rear surface of a pocket-sized mobile phone, comprising:

a housing with a top and bottom surface both of an overall footprint substantially smaller than that of a rear surface of a pocket-sized mobile phone to which said housing is capable of being secured, said top surface comprising a reflective, mirror-like surface and said bottom surface comprising an adhesive layer for securing said housing to a rear surface of a pocket-sized mobile phone, each of said top and bottom surfaces of said housing having a front surface with an opening formed between said front surfaces a suitably sized drawer comprising a bottom, a pair of opposed side walls and a front face held in said housing for sliding within and through said front opening, said drawer having mechanical retention and removal means for selectively and easily allowing both access to said drawer and manual removal of said drawer from said housing for replacement, as desired, said drawer having a footprint, the combined footprint of said drawer and said housing, even when said drawer is slid out to its maximum extent from said housing while still being held by said housing, covering an area smaller than that of a rear surface of a pocket-sized mobile phone to which said housing is capable of being secured, said drawer having one or more compartments for holding a personal care product, and said drawer being further provided with gripping and sliding means to facilitate the gripping of said drawer and the sliding in and out of said drawer within said housing.

2. A personal care product container as claimed in claim 1 wherein said adhesive layer is pressure-activated.

3. A personal care product container as claimed in claim 1 wherein said adhesive layer is initially provided with removable release paper.

4. A personal care product container as claimed in claim 1 wherein said drawer is provided with a personal care product of a cosmetic selected from the group comprising lip gloss, lip stick, blush, and/or eye shadow.

5. A personal care product container as claimed in claim 1 wherein said gripping and sliding means is a pair of opposed finger gripping surfaces adapted to facilitate the sliding of said drawer into and out of said housing.

6. A personal care product container as claimed in claim 5 wherein said opposed finger gripping surfaces extend outwardly from sides of said drawer and near said front face of said drawer.

7. A personal care product container as claimed in claim 6 wherein said finger gripping surfaces are raised ridges.

8. A personal care product container as claimed in claim 1, wherein said adhesive layer comprises either one of hook and loop cooperating fastener materials located on the bottom of said housing.

9. A personal care product container as claimed in claim 1, further comprising a light source disposed in said housing to illuminate either said reflective mirror-like surface or the contents of said drawer.

10. A personal care product container as claimed in claim 9, further comprising a power connection for said light source connectable to a pocket-sized mobile phone to which said housing is capable of being secured.

11. A personal care product container as claimed in claim 1 wherein said adhesive layer is heat-activated.

* * * * *